US010337820B2

(12) United States Patent
Jager

(10) Patent No.: US 10,337,820 B2
(45) Date of Patent: Jul. 2, 2019

(54) FIREARM MUZZLE DEVICE CLAMP

(71) Applicant: John Jager, Plainwell, MI (US)

(72) Inventor: John Jager, Plainwell, MI (US)

( * ) Notice: Subject to any disclaimer, the term of this patent is extended or adjusted under 35 U.S.C. 154(b) by 0 days.

(21) Appl. No.: 15/820,116

(22) Filed: Nov. 21, 2017

(65) Prior Publication Data

US 2019/0154388 A1 May 23, 2019

(51) Int. Cl.

| | |
|---|---|
| ***F41A 21/00*** | (2006.01) |
| ***F41A 21/36*** | (2006.01) |
| ***F41A 21/32*** | (2006.01) |
| ***F41G 1/02*** | (2006.01) |

(52) U.S. Cl.

CPC ..... *F41A 21/36* (2013.01); *F41A 21/325* (2013.01); *F41G 1/02* (2013.01)

(58) Field of Classification Search

CPC ..... F41A 21/30; F41A 21/32; F41A 21/325; F41A 21/34; F41A 21/36; F41A 21/38

See application file for complete search history.

(56) References Cited

U.S. PATENT DOCUMENTS

| | | | | | |
|---|---|---|---|---|---|
| 2,348,114 | A * | 5/1944 | Dow | F41A 21/36 | 89/14.3 |
| 2,953,972 | A * | 9/1960 | Sorensen | F41A 21/325 | 261/114.1 |
| 4,429,614 | A * | 2/1984 | Tocco | F41A 21/36 | 89/14.3 |
| 4,939,977 | A * | 7/1990 | Stroup | F41A 21/30 | 89/14.4 |
| 5,119,716 | A * | 6/1992 | Bartolles | F41A 21/30 | 89/14.3 |
| 5,509,345 | A * | 4/1996 | Cyktich | F41A 21/325 | 42/97 |
| 7,854,085 | B1 * | 12/2010 | Hodgkins | F41C 27/16 | 42/85 |
| 2003/0019352 | A1 * | 1/2003 | Mika | F41A 21/36 | 89/14.05 |
| 2003/0154849 | A1 * | 8/2003 | Breuer | F41A 21/36 | 89/14.3 |
| 2004/0244571 | A1 * | 12/2004 | Bender | F41A 21/38 | 89/14.3 |
| 2010/0224054 | A1 * | 9/2010 | Langner | F41A 21/34 | 89/14.3 |

* cited by examiner

*Primary Examiner* — Gabriel J. Klein

(57) ABSTRACT

An apparatus to be mounted onto a muzzle of a firearm consists of a muzzle device, a clamp, and a fastening mechanism. The muzzle device can be a compensator or a muzzle brake. The clamp and the fastening mechanism is used to hold the muzzle device against the barrel of the firearm. The muzzle device consists of a barrel receiving aperture that traverses through a structural body. When a muzzle of a firearm is positioned within the barrel receiving aperture, the clamp is pressed against the structural body so that the fastening mechanism can be used to secure the muzzle device in place. Since the apparatus does not utilize the threads located on the barrel of the firearm, the overall quality of the threads is preserved.

7 Claims, 7 Drawing Sheets

FIREARM MUZZLE DEVICE CLAMP

FIELD OF THE INVENTION

The present invention relates generally to muzzle devices. More specifically, the present invention introduces an apparatus that can be clamped to the muzzle section of the barrel of a firearm. By utilizing the present invention, the threads on the firearm barrel remain unharmed and an external muzzle device can be mounted or removed promptly.

BACKGROUND OF THE INVENTION

A muzzle device is generally used on the muzzle of a firearm or cannon. Muzzle devices are used to redirect propellant gasses to counter recoil and unwanted rising of the barrel during rapid fire. Even though there are significant advantages of using a muzzle device, there are some notable disadvantages too. The present invention intends to address the drawbacks of using a muzzle device.

The cost and the tedious process involved are some of the main disadvantages related with existing muzzle devices. In particular, the cost related with existing muzzle devices and the complex process can discourage many users from utilizing a muzzle device. Thus, an efficient and financially advantageous means of installing a muzzle device is clearly needed.

Most existing muzzle devices are attached to the muzzle via threaded connections. Thus, when the muzzle device is installed, the muzzle device is rotated in a clockwise direction. When the carbon buildup on the muzzle needs to be removed or the muzzle device needs to be replaced, the muzzle device is rotated in a counterclockwise direction so that the muzzle device is detached from the barrel. Over time, the repeated use of the threads on the muzzle can damage the threading. Moreover, the threads on the muzzle device can also be damaged and using the muzzle device on a different firearm can be problematic. Thus, the firearm owner must undergo additional maintenance expenses.

The objective of the present invention is to address the aforementioned issues. In particular, the present invention introduces a clamping mechanism for the muzzle device such that the threading of the firearm barrel remains unharmed. By utilizing the present invention, the muzzle device can be mounted onto the barrel with a clamping mechanism within a short time period and thus maximizing efficiency.

DETAIL DESCRIPTIONS OF THE INVENTION

All illustrations of the drawings are for the purpose of describing selected versions of the present invention and are not intended to limit the scope of the present invention.

The present invention introduces a muzzle device that is attached to a muzzle of a firearm using a clamping mechanism. The present invention eliminates the need of using the threads of the firearm barrel when attaching a muzzle device. In addition to protecting the threads of the barrel, the present invention allows the user to promptly mount and dismount the muzzle device.

Figure 1:
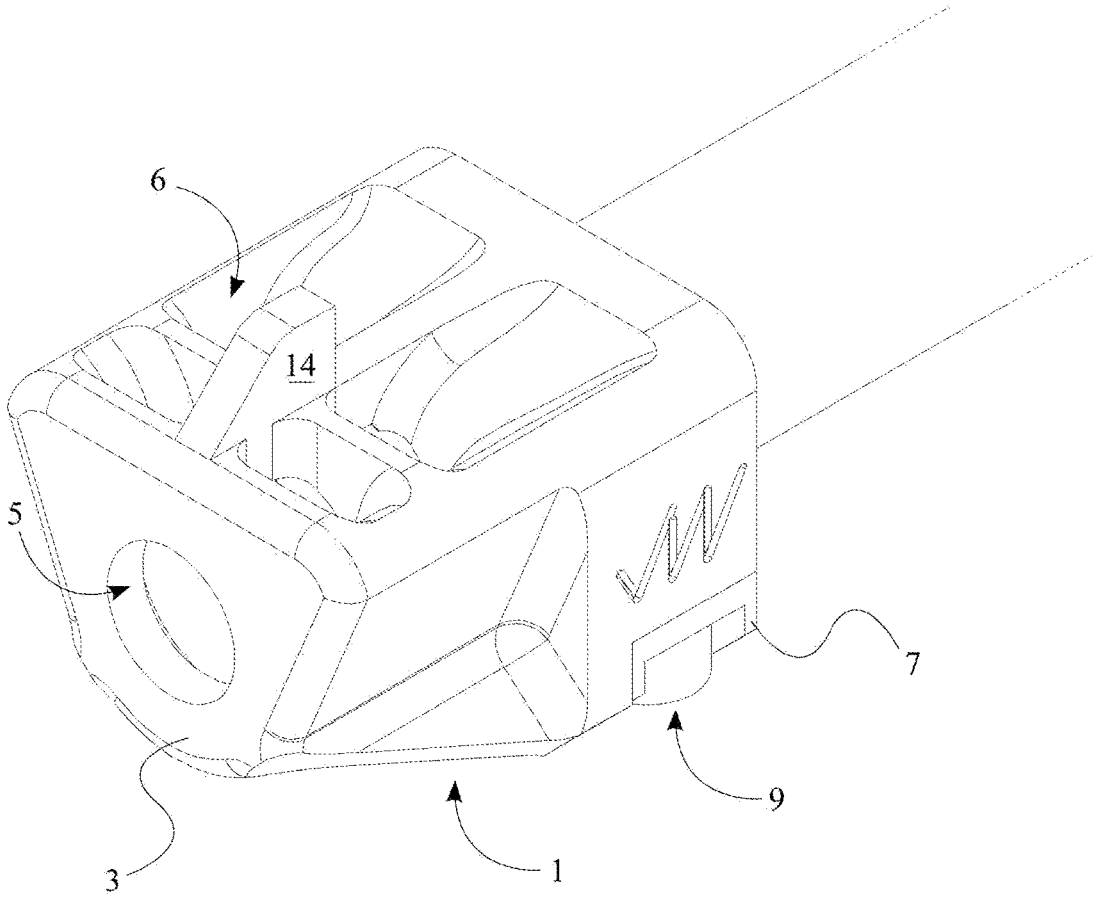
FIG. 1 is a perspective view of the present invention being used on a barrel.

As shown in FIG. 1 and FIG. 2, the present invention comprises a muzzle device 1, a clamp 7, and a fastening mechanism 8. The muzzle device 1 is terminally mounted to the barrel of the firearm to reduce muzzle rise. In the preferred embodiment of the present invention, the muzzle device 1 is a compensator. In another embodiment of the present invention, the muzzle device 1 can be, but is not limited to, a muzzle brake. The clamp 7 is removably attached to the muzzle device 1 with the fastening mechanism 8 so that the muzzle device 1 remains stationary at the muzzle. Since the fastening mechanism 8 eliminates the need of using the threads on the barrel, the threads of the barrel are not damaged by repeatedly using the muzzle device 1. Additionally, since no threads are required when attaching the muzzle device 1, the present invention can also be used on a firearm in which the threads are already damaged.

As illustrated in FIGS. 1-5, for the muzzle device 1 to be appropriately positioned on the barrel, the muzzle device 1 comprises a first end 2, a second end 3, a structural body 4, a barrel receiving aperture 5, and at least one gas discharge vent 6. Since the structural body 4 extends from the first end 2 to the second end 3, a distance from the first end 2 to the second end 3 determines a length of the structural body 4. The length of the structural body 4 can vary in different embodiments of the present invention. As an example, the length of the structural body 4 can depend on the firearm the muzzle device 1 is being used on. The barrel receiving aperture 5 is used to position a muzzle portion of the barrel which in the final configuration receives the muzzle device 1. To do so, the barrel receiving aperture 5 centrally traverses through the structural body 4 from the first end 2 to the second end 3. Therefore, a radius 100 of the barrel receiving aperture 5 at the first end 2 is selected such that the muzzle tightly fits within the barrel receiving aperture 5. Moreover, the radius 100 of the barrel receiving aperture 5 at the first end 2 is designed to be greater that a radius 200 of the barrel receiving aperture 5 at the second end 3. The difference in radius prevents the muzzle device 1 from sliding along the attachment point on the barrel. The present invention further comprises a stoppage band 15 that helps the muzzle device 1 remain stationary on the barrel. The stoppage band 15, with a radius equivalent to a radius of the muzzle, is concentrically and perimetrically positioned within the barrel receiving aperture 5 adjacent to the first end 2. In the final configuration of utilizing the present invention, the muzzle of the firearm remains stationary by being pressed against the stoppage band 15 within the barrel receiving aperture 5.

Figure 2A:
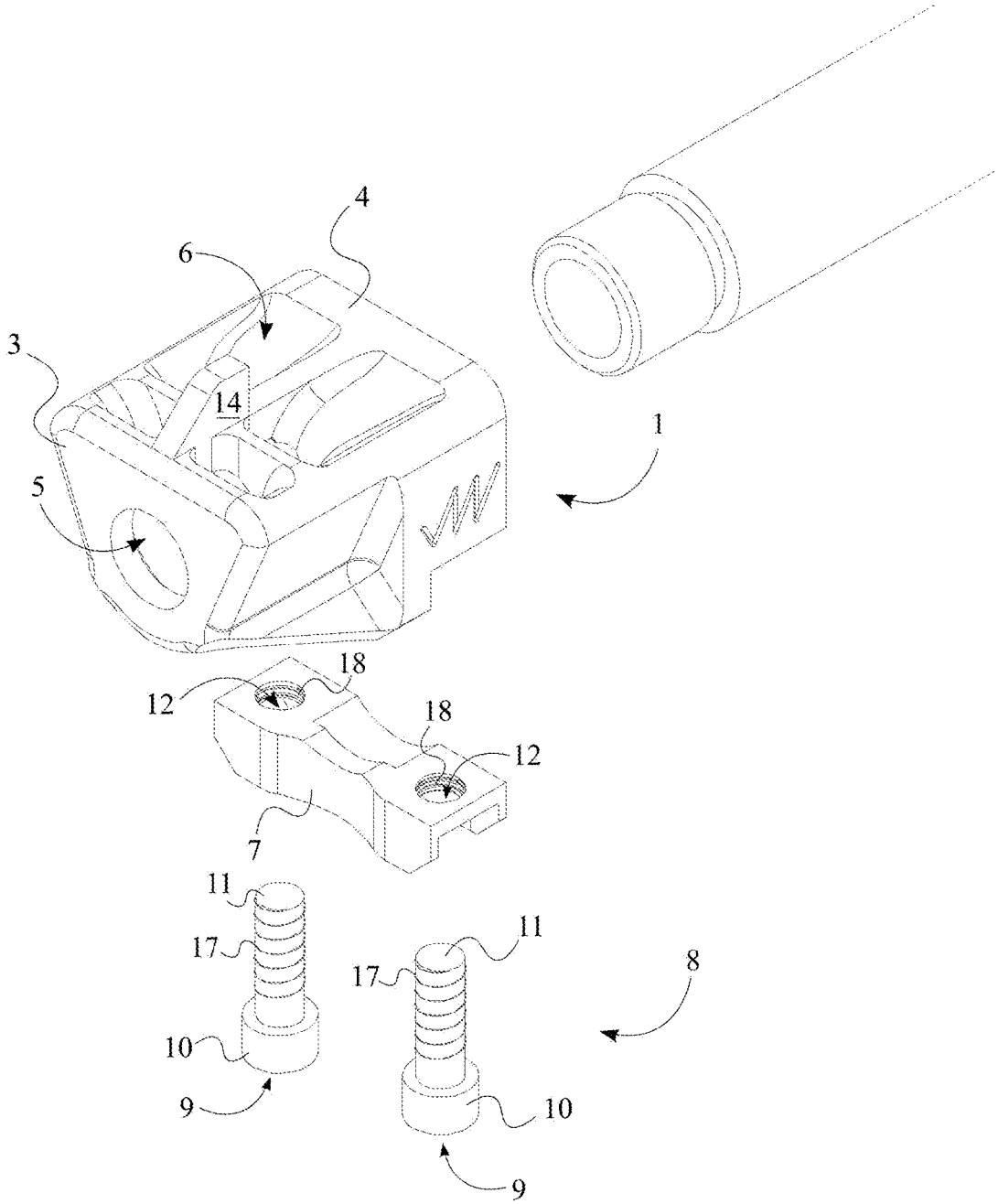
FIG. 2A is an exploded top perspective view of the present invention and the barrel.

The at least one gas discharge vent 6 is used to divert combustion gases away from the muzzle. As a result of the mentioned gas rerouting, the momentum of the diverted combustion gases does not add to the recoil that occurs from firing the firearm. As shown in FIG. 1 and FIG. 2A, to fulfill the functionalities of the compensator or the muzzle brake the at least one gas discharge vent 6 traverses into the structural body 4 perpendicular to the barrel receiving aperture 5 such that the at least one gas discharge vent 6 is in gaseous communication with the barrel receiving aperture 5. For effective muzzle rise reduction, the at least one gas discharge vent 6 traverses through a top surface of the structural body 4. The positioning of the at least one discharge vent 6 mitigates the muzzle rise by exerting a force equal in magnitude and opposite in direction.

Figure 2B:
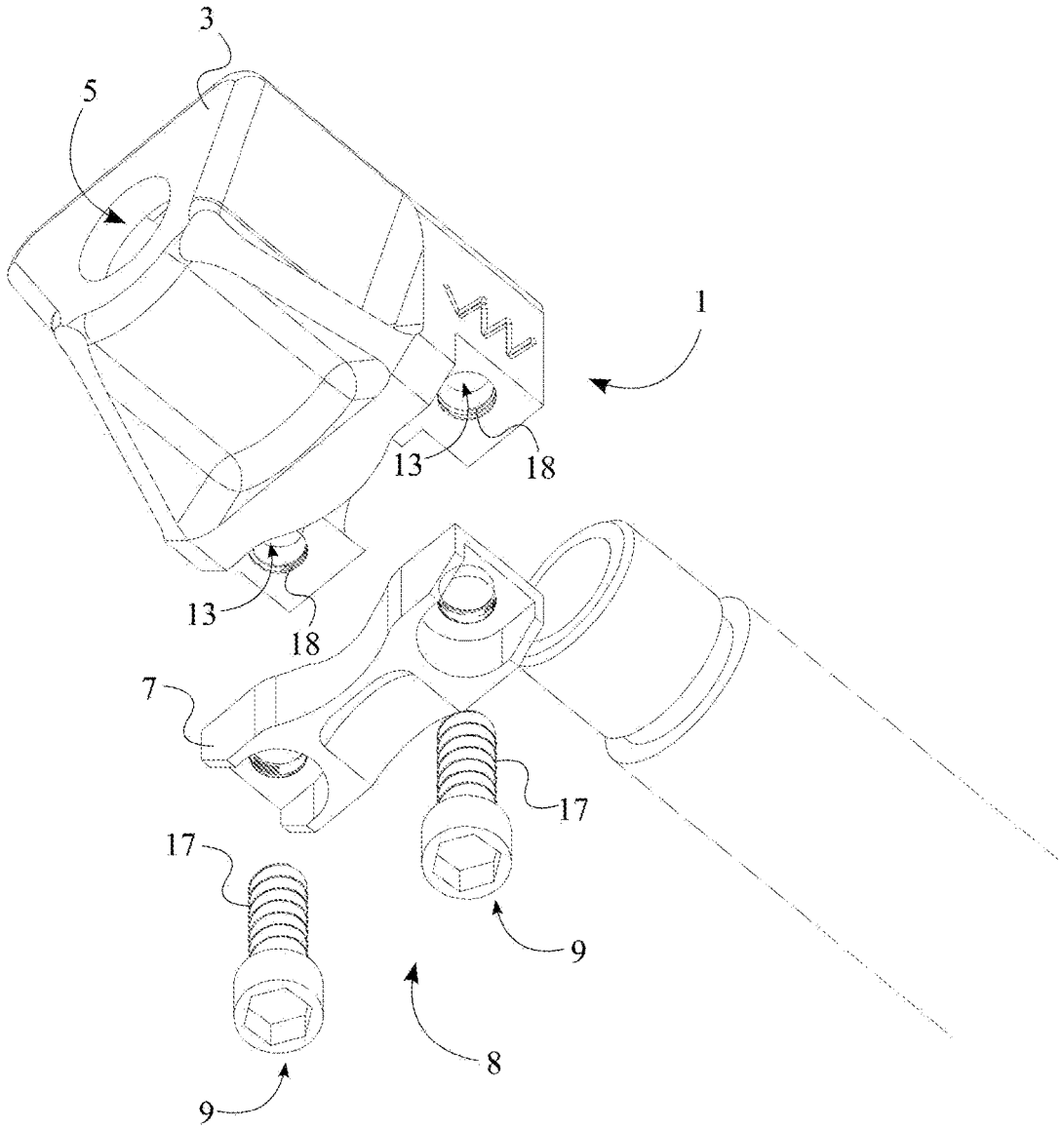
FIG. 2B is an exploded bottom perspective view of the present invention and the barrel.
Figure 3:
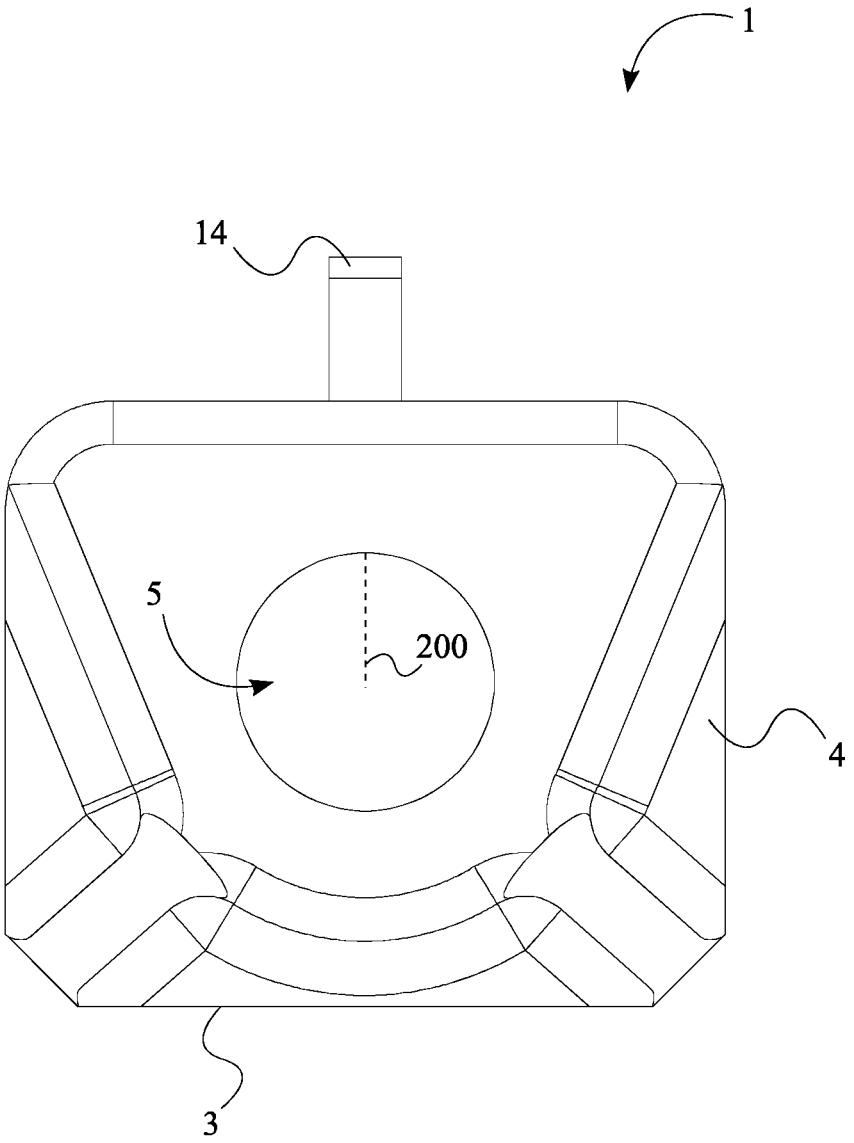
FIG. 3 is a front view of the muzzle device.
Figure 4:
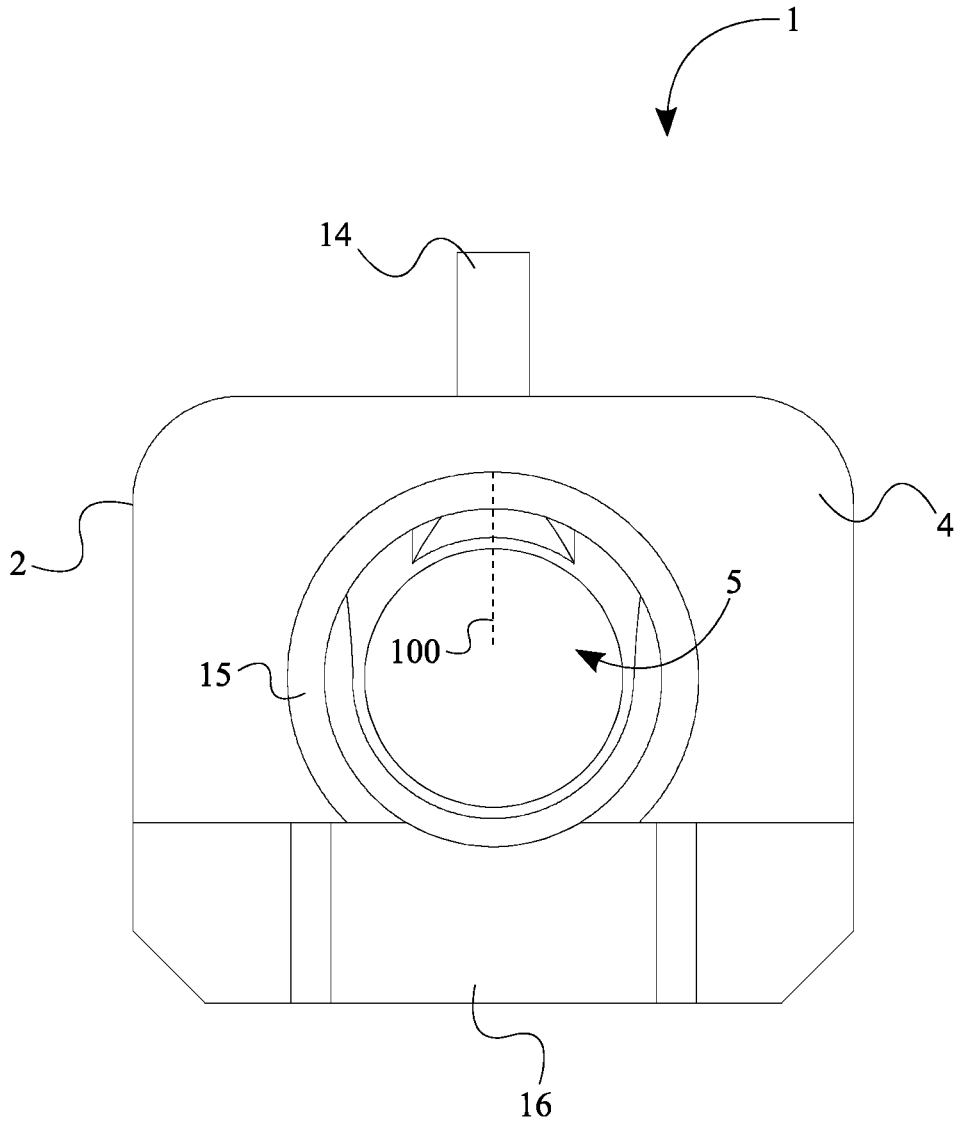
FIG. 4 is a rear view of the muzzle device.
Figure 6:
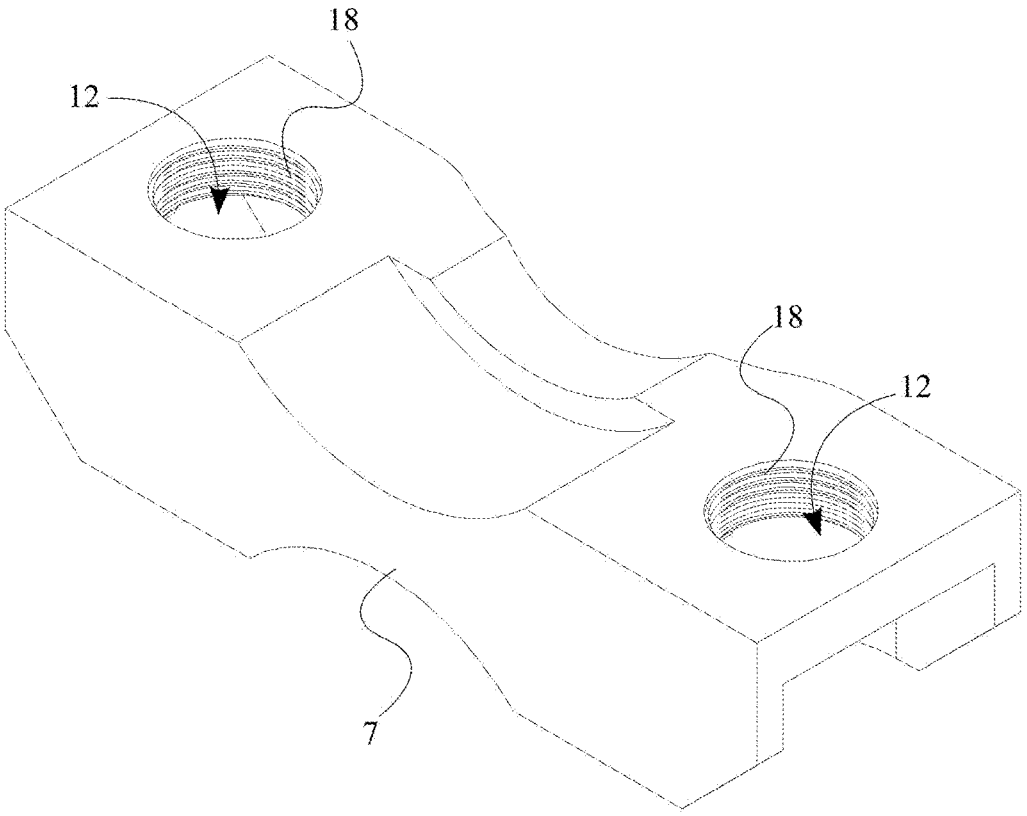
FIG. 6 is a perspective view of the clamp.

As discussed earlier, the fastening mechanism 8 of the present invention secures the muzzle device 1 to the barrel via the clamp 7. As shown in FIG. 2A and FIG. 2B, in the preferred embodiment of the present invention, the fastening mechanism 8 comprises at least one screw 9, at least one first receiving hole 12, and at least one second receiving hole 13. In other words, the at least one screw 9, the at least one first receiving hole 12, and the at least one second receiving hole 13 are used to secure the muzzle device 1 onto the barrel with the use of the clamp 7. In doing so, the at least one first receiving hole 12 perpendicularly traverses through the clamp 7 as shown in FIG. 6. To correspond with the at least one first receiving hole 12, the at least one second receiving hole 13 traverses into the structural body 4 perpendicular to the barrel receiving aperture 5 and adjacent to the first end 2. The positioning of the at least one second receiving hole 13 ensures that the muzzle device 1 is secured in close proximity to the threads of the barrel. More specifically, the positioning of the at least one second receiving hole 13 ensures that the present invention is positioned along the barrel at a position where an existing compensator or an existing muzzle brake would be generally attached. To position and secure the muzzle device 1 as required, the at least one first receiving hole 12 is concentrically aligned with the at least one second receiving hole 13. When concentrically aligned, the at least one screw 9 is removably positioned into the at least one first receiving hole 12 and the at least one second receiving hole 13 such that the clamp 7 is pressed against the structural body 4 securing the muzzle device 1 on the barrel. Even though the invention is described with the at least one screw 9, the at least one first receiving hole 12, and the at least one second receiving hole 13, preferably, the present invention will utilize a pair of screws with a first pair of receiving holes and a second pair of receiving holes as shown in FIG. 2A and FIG. 2B. Regardless of the number of screws used, the at least one screw 9 further comprises a screw head 10 and a screw body 11. When fastening the muzzle device 1 with the use of the clamp 7, the screw body 11 is positioned within the at least one first receiving hole 12 and the at least one second receiving hole 13. Since the screw head 10 is terminally connected to the screw body 11, the screw head 10 is pressed against the clamp 7 securing the muzzle device 1 between the barrel and the clamp 7 in the final configuration. The present invention utilizes a first set of threads 17 and a second set of threads 18 to hold the at least one screw 9 stationary within the at least one first receiving hole 12 and the at least one second receiving hole 13. The first set of threads 17 is externally distributed along the screw body 11. The second set of threads 18 is internally distributed along the at least one first receiving hole 12 and the at least one second receiving hole 13. Thus, when the at least one screw 9 is fastened, the first set of threads 17 is engaged with the second set of threads 18.

Figure 5:
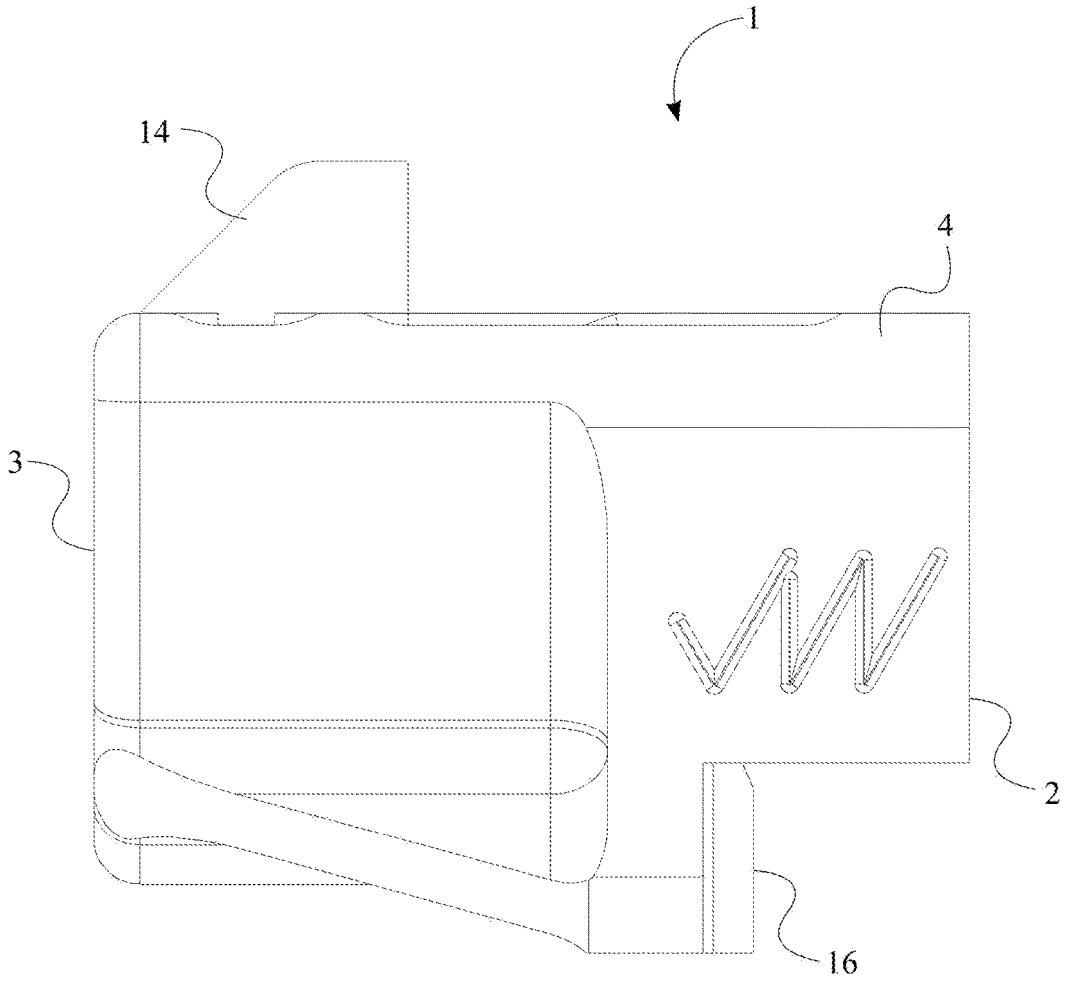
FIG. 5 is a side view of the present invention.

As seen in FIG. 5, the present invention further comprises a positioning groove 16 that allows the clamp 7 to be appropriately positioned on the muzzle device 1. More specifically, the positioning groove 16, which is L-shaped in the preferred embodiment, is integrated into the structural body 4 adjacent the first end 2 so that the muzzle device 1 can be clamped to the barrel in close proximity to the threads of the barrel. The positioning groove 16 allows the muzzle device 1 to maintain the overall cubical shape when the clamp 7 is attached. More specifically, by using the positioning groove 16, the clamp 7 remains flush against the structural body 4 with no external protrusion.

Iron sights are generally used on firearms as alignment markers to assist in aiming. As illustrated in FIG. 1 and FIGS. 3-5, since the present invention is used on a front end of a firearm, the present invention further comprises a front iron sight 14 that is centrally mounted onto the structural body 4 adjacent to the at least one gas discharge vent 6. In order to be mounted furthest away from the user, the front iron sight 14 is positioned adjacent the second end 3 of the muzzle device 1.

When utilizing the present invention, the following process flow is generally followed. Initially, the barrel is inserted into the barrel receiving aperture 5 so that the muzzle is pressed against the stoppage band 15. When aligned as necessary, the clamp 7 is positioned into the positioning groove 16. When the at least one first receiving hole 12 of the clamp 7 and the at least one second receiving hole 13 of the muzzle device 1 are concentrically aligned with each other, the at least one screw 9 is inserted to the at least one first receiving hole 12 and the at least one second receiving hole 13. By fastening the at least one screw 9, the muzzle device 1 is mounted onto the muzzle and remains stationary at the intended position. When the muzzle device 1 needs to be removed, the user removes the at least one screw 9 so that the muzzle device 1 can be conveniently removed.

Although the invention has been explained in relation to its preferred embodiment, it is to be understood that many other possible modifications and variations can be made without departing from the spirit and scope of the invention as hereinafter claimed.

What is claimed is:

1. A firearm muzzle system comprising:

a muzzle device;

a clamp;

at least one screw;

the muzzle device comprising a first end, a second end, a structural body, a barrel receiving aperture and at least one gas discharge vent;

the first end and the second end being oppositely located to each other;

the structural body extending from the first end to the second end;

the barrel receiving aperture centrally traversing through the structural body from the first end to the second end;

the at least one gas discharge vent traversing into the structural body;

the at least one gas discharge vent being perpendicularly oriented to the barrel receiving aperture;

the at least one gas discharge vent being in gaseous communication with the barrel receiving aperture;

the clamp comprising at least one first receiving hole perpendicularly traversing therethrough;

the muzzle device comprising at least one second receiving hole;

the at least one second receiving hole traversing into the structural body;

the at least one second receiving hole being perpendicularly oriented to the barrel receiving aperture;

the at least one second receiving hole being adjacently located to the first end;

the clamp being removably attached to the muzzle device by the at least one screw being removably positioned into the at least one first receiving hole and the at least one second receiving hole;

the at least one first receiving hole and the at least one second receiving hole being concentrically aligned with each other in response to the at least one screw being positioned into the at least one first receiving hole and the at least one second receiving hole;

the structural body and the clamp being pressed against each other in response to the at least one screw being positioned into the at least one first receiving hole and the at least one second receiving hole;

the muzzle device comprising a front iron sight;

the front iron sight being centrally mounted on the structural body;

the front iron sight being adjacently located to the at least one gas discharge vent;

the front iron sight being adjacently located to the second end; and a stoppage band; the stoppage band being concentrically and perimetrically positioned within the barrel receiving aperture; and the stoppage band being adjacently located to the first end and at least partially formed on the clamp.

2. The firearm muzzle system as claimed in claim 1 comprising:

the at least one screw comprising a screw head and a screw body;

the screw head being terminally connected to the screw body;

the screw body being positioned within the at least one first receiving hole and the at least one second receiving hole in response to the at least one screw being positioned into the at least one first receiving hole and the at least one second receiving hole; and the screw head being pressed against the clamp in response to the at least one screw being positioned into the at least one first receiving hole and the at least one second receiving hole.

3. The firearm muzzle system as claimed in claim 2 comprising:

the at least one screw comprising a first set of threads;

a second set of threads;

the first set of threads being externally distributed along the screw body;

the second set of threads being internally distributed along the at least one first receiving hole and the at least one second receiving hole; and the first set of threads being engaged with the second set of threads in response to the at least one screw being positioned into the at least one first receiving hole and the at least one second receiving hole.

4. The firearm muzzle system as claimed in claim 1, wherein a radius of the barrel receiving aperture at the first end is greater than a radius of the barrel receiving aperture at the second end.

5. The firearm muzzle system as claimed in claim 1 comprising:

the muzzle device comprising a positioning groove;

the positioning groove being integrated into the structural body;

the positioning groove being adjacently located to the first end; and the clamp being inserted into the positioning groove in response to the at least one screw being positioned into the at least one first receiving hole and the at least one second receiving hole.

6. The firearm muzzle system as claimed in claim 1, wherein the muzzle device is a compensator.

7. The firearm muzzle system as claimed in claim 1, wherein the muzzle device is a muzzle brake.

* * * * *